US005529457A

United States Patent [19]

Terasaki et al.

[11] Patent Number: 5,529,457

[45] Date of Patent: Jun. 25, 1996

[54] CENTRIFUGAL COMPRESSOR

[75] Inventors: Masatosi Terasaki, Tsuchiura; Koji Nakagawa, Funabashi, both of Japan

[73] Assignee: Hitachi, Ltd., Tokyo, Japan

[21] Appl. No.: 397,880

[22] Filed: Mar. 2, 1995

[30] Foreign Application Priority Data

Mar. 18, 1994 [JP] Japan ..... 6-048272

[51] Int. Cl.[6] ..... F04D 29/30

[52] U.S. Cl. ..... 415/208.3; 415/208.4

[58] Field of Search ..... 415/208.2, 208.3, 415/208.4, 211.2, 914

[56] References Cited

U.S. PATENT DOCUMENTS

| | | | |
|---|---|---|---|
| 3,973,872 | 8/1976 | Seleznev et al. | 415/208.3 |
| 5,178,516 | 1/1993 | Nakagawa et al. . | |
| 5,316,441 | 5/1994 | Osborne | 415/208.4 |

FOREIGN PATENT DOCUMENTS

| | | | |
|---|---|---|---|
| 0628084 | 9/1961 | Canada | 415/208.3 |
| 0183899 | 10/1983 | Japan . | |
| 0247798 | 10/1989 | Japan . | |

OTHER PUBLICATIONS

Clements, W. W. "The Influence of Diffuser Channel Geometry on the Flow Range and Efficiency of a Centrifugal Compressor." Proceedings of the Institution of Mechanical Engineers, vol. 201, No. A2 (1987), pp. 145–152.

Pampreen, R. C. "Automotive Research Compressor Experience". American Society of Mechanical Engineers, Paper 89–6T–61 (Jun. 4–8, 1989), pp. 1–7.

*Primary Examiner*—Edward K. Look
*Assistant Examiner*—Christopher Verdier
*Attorney, Agent, or Firm*—Antonelli, Terry, Stout & Kraus

[57] ABSTRACT

A centrifugal compressor has a diffuser operative to convert the kinetic energy of fluid discharged from an impeller into pressure and having a shroud, a main shroud, and stationary vanes disposed in the diffuser. The distance between the shroud and the main shroud is smaller at an inlet side of the diffuser than at an outlet side thereof. The stationary vanes are integral with the one of the shroud and the main shroud that is perpendicular to the axis of rotation of the impeller so that an end surface of each of the stationary vanes forms a free end.

7 Claims, 7 Drawing Sheets

CENTRIFUGAL COMPRESSOR

BACKGROUND OF THE INVENTION

The present invention relates generally to centrifugal compressors and, more particularly, to a centrifugal compressor which provides a particularly wide operating range and a high efficiency.

Generally, in diffusers having stationary vanes, the ratio of the sectional areas between the stationary vanes at the outlet and inlet sides of flow passages is set to a value larger than 1 (the sectional area at the outlet side is greater than the sectional area at the inlet side) in order to reduce the flow rate of a fluid by the stationary vanes. On the other hand, for a reduction in the overall size of a compressor, it is desirable to minimize the outer diameter of a diffuser for the compressor. It is known that it is effective to increase the widths of the stationary vanes at the outlet side relative to the widths thereof at the inlet side in minimizing the outer diameter of the diffuser (as disclosed, for example, in Japanese Unexamined Patent Publication No. 58-183899).

In centrifugal compressors having diffusers with vanes, the operating range is limited by the diffuser; it is limited by the occurrence of choking at the high-flow-rate side and is limited by stall of the diffuser at the low-flow-rate side. The sectional area of the flow passages between the stationary vanes dominantly influences the occurrence of choking, and the sectional area of the flow passages between the stationary vanes and the vane angle influence the stall. As means for preventing the stall, solutions are known in one of which the front edges of the stationary vanes are inclined from the shroud to the main shroud and in the other of which auxiliary vanes are provided in the vicinity of the front edges of the stationary vanes (for example, Japanese Unexamined Patent Publication 1-247798).

In the arrangement disclosed in Japanese Unexamined Patent Publication No. 58-183899, the spacing between stationary vanes is varied so as to be larger at the inlet side than at the outlet side and, accordingly, the vane angle at the outlet side is closer to the radial direction than that at the inlet side so that the flow at the outlet is closer to the radial direction, with a result that the loss is increased at the low-flow-rate side (the loss is particularly large if a scroll is formed on the downstream side of the diffuser). The number of working steps is increased since the surface on which the stationary vanes are formed or supported is curved.

In the arrangement disclosed in Japanese Unexamined Patent Publication 1-247798, it is possible to suppress the stall even at the low-flow-rate side by the effect of the shape of the front edges of the stationary vanes or the auxiliary vanes, but the loss at the downstream side of the diffuser is large.

SUMMARY OF THE INVENTION

An object of the present invention is to provide a centrifugal compressor which can be worked easily by machining and which provides a widened operating range and a high efficiency.

To achieve this object, according to one aspect of the present invention, there is provided a centrifugal compressor comprising an impeller, a diffuser operative to convert the kinetic energy of fluid discharged from the impeller into pressure and having a shroud and a main shroud, one of the shroud and the main shroud being perpendicular to the axis of rotation of the impeller, and stationary vanes disposed in the diffuser, wherein the distance between the shroud and the main shroud is smaller at an inlet side of the diffuser than at an outlet side of the diffuser, the stationary vanes are integral with the one of the shroud and the main shroud that is perpendicular to the axis of rotation of the impeller so that an end surface of each of the stationary vanes at an end of the vane in the direction of the height of the vane forms a free end, and the height of each stationary vane is lower at the inlet side than at the outlet side.

Since each stationary vane is formed integrally with the flat surface of one of the shroud or the main shroud that is perpendicular to the axis of rotation of the impeller, and has a free end, a surface of a blank from which the stationary vanes and the shroud or the main shroud on which the stationary vanes are supported can be machined easily because the surface is flat.

According to another aspect of the present invention, an angle of each stationary vane adjacent the outlet side to the radial direction of the impeller is larger than an angle of the stationary vane adjacent the inlet side to the radial direction of the impeller, whereby the stall at the low-flow-rate side is reduced to widen the operating range.

According to still another aspect of the present invention, a front edge portion of each stationary vane adjacent the shroud is closer to the impeller than the other front edge portion of the stationary vane adjacent the main shroud, or alternatively, auxiliary vanes are formed integrally with the one of the shroud and the main shroud that is perpendicular to the axis of rotation of the impeller, each of the auxiliary vanes having a chord shorter than that of each of the stationary vanes and a height equal to or smaller than that of each of the stationary vanes, and the auxiliary vanes are disposed adjacent the inlet ends of the stationary vanes such that one of two surfaces of each auxiliary vane is opposed to an associated stationary vane. Therefore, the front edges of the stationary vanes or the auxiliary vanes forcibly guide the flow of the liquid from the impeller so that the occurrence of a reverse flow between the outlet side of the impeller and the front edges of the stationary vanes is suppressed. The stall in the diffuser is thereby reduced even at the low-flow-rate side to widen the operating range.

According to a further aspect of the present invention, a partition plate is connected to a downstream end of each of the auxiliary vanes and extends along an associated stationary vane, the partition plate having a height lower than that of the auxiliary vane, to suppress eddies from root portions of the auxiliary vanes. The amount of energy of the flow consumed by such eddies can thereby be reduced to increase the efficiency of the centrifugal compressor.

Further, the width of the diffuser at the inlet side is reduced relative to that at the outlet side to reduce the width of each stationary vane at the inlet side relative to that at the outlet side. The radial velocity of the flow at the outlet side can thereby be reduced, so that the loss of energy of the radial velocity is decreased.

The above and other objects, features and advantages of the present invention will become more apparent from the following detailed description of the preferred embodiments of the invention with reference to the accompanying drawings.

DESCRIPTION OF THE PREFERRED EMBODIMENTS

The preferred embodiments of the present invention will be described below with reference to the accompanying drawings.

Figure 1:
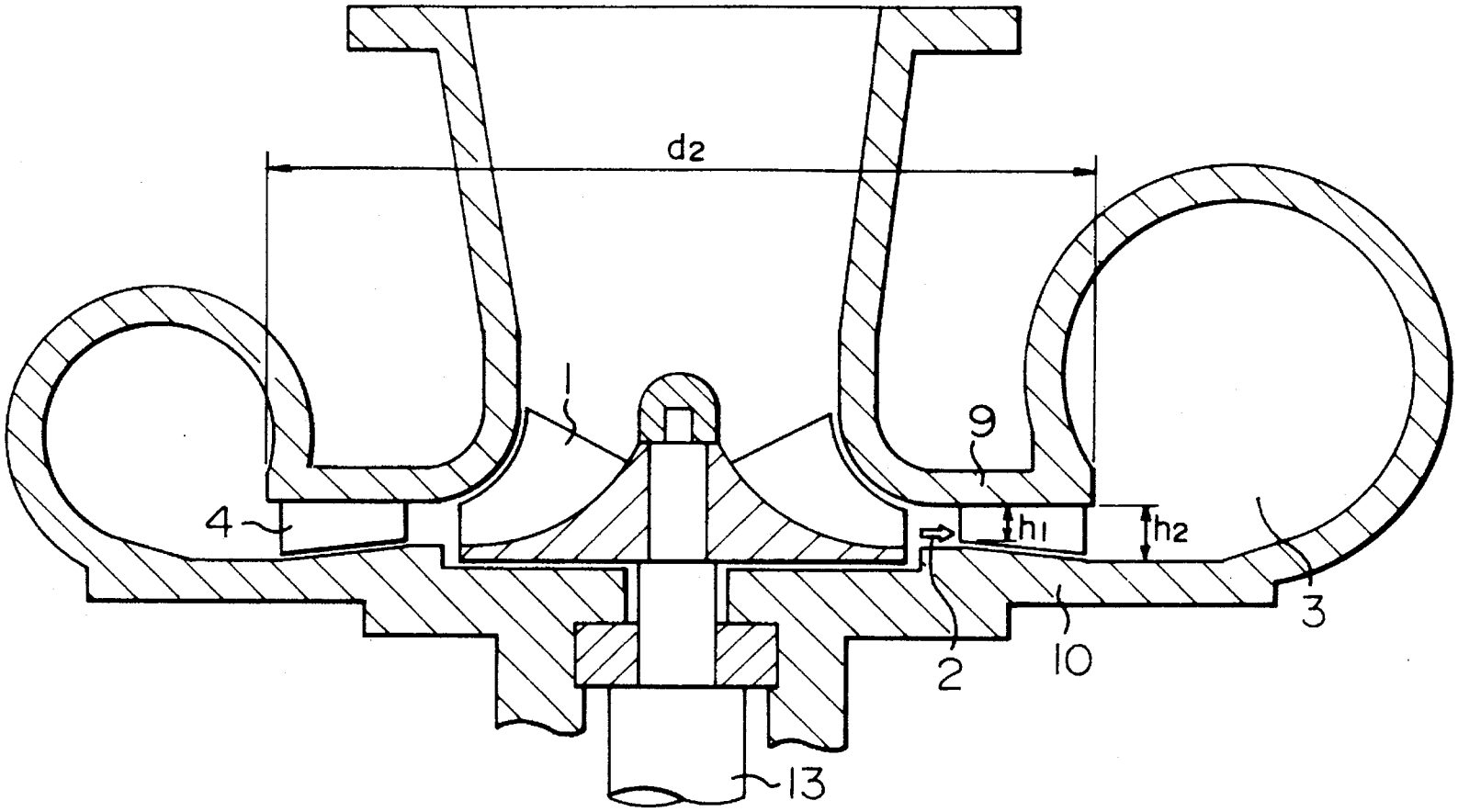
FIG. 1 is a cross-sectional view of an embodiment Of a centrifugal compressor in accordance with the present invention taken on a plane containing the axis of rotation of an impeller.
Figure 2:
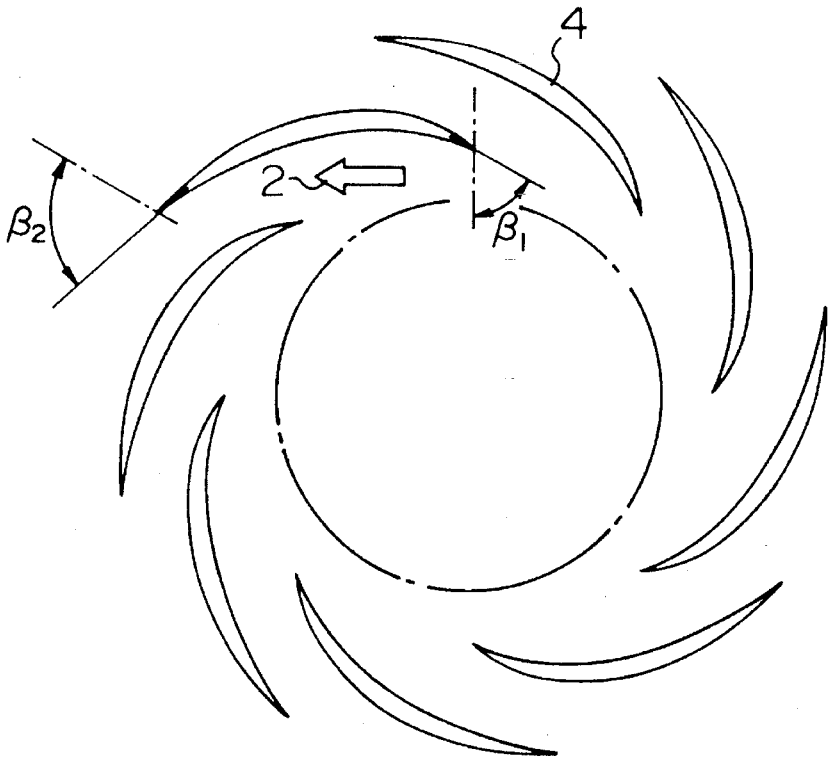
FIG. 2 is a plan view of the stationary vanes of the embodiment shown in FIG. 1 showing the arrangement of the vanes.

Referring to FIGS. 1 and 2 which illustrate the first embodiment of the present invention, a flow 2 of fluid compressed by an impeller 1 is introduced into a diffuser formed by a shroud 9 and a main shroud 10. Stationary vanes 4 are disposed in the diffuser to convert the kinetic energy of the flow 2 into pressure at a high efficiency. The flow 2 flowing out of the diffuser is guided through a scroll 3 to a pipe line (not shown) connected to the discharge side of the compressor. For high-efficiency conversion of the kinetic energy of the flow 2 into pressure, it is necessary to set the sectional area of passages between the stationary vanes 4 at the diffuser outlet side to a certain large value. Accordingly, the vane angle $\beta_2$ between the edge of each stationary vane 4 at the outlet side and the radial direction is set to be greater than the vane angle $\beta_1$ between the edge of the vane at the inlet side and the radial direction. On the other hand, it is desirable to set the outlet-side stationary vane angle $\beta_2$ to be greater than the inlet-side vane angle $\beta_1$ because a substantial part of the kinetic energy of the radial velocity component of the flow into the scroll 3 is lost by the impingement with the flow in the scroll 3. Since the outlet side height $h_2$ of each of the stationary vanes 4 is larger than the inlet side height hi, a necessary flow passage sectional area can easily be provided between the stationary vanes 4 at the outlet side. Accordingly, the outlet diameter $d_2$ can be reduced in comparison with the case where $h_2$ is equal to $h_1$, so that the overall size of the centrifugal compressor can be reduced. Further, because the compressor can be constructed so that the outlet-side vane angle $\beta_2$ can be greater than the inlet-side vane angle $\beta_1$, the radial velocity component at the outlet-side can be reduced, so that the loss, in the scroll 3, of the flow from the diffuser is reduced. By this effect, the energy efficiency of the centrifugal compressor can be increased.

In the conventional arrangement, one or both of the shroud 9 and the main shroud 10 are shaped so as to have a curved surface such as a conical surface if the outlet side height $h_2$ and the inlet side height hi of each of the stationary vanes 4 are different from each other. In such a case, it is difficult to work the material of the stationary vanes 4. That is, in a case where the stationary vanes 4 and the shroud 9 or the main shroud 10 to which the stationary vanes 4 are fixed are formed integrally with each other by cutting a blank, it is difficult to shape with a lathe each of the portions of the shroud 9 or the main shroud 10 between the stationary vanes 4 into a curved surface (e.g., a conical surface). In such a case, a long time is needed for finishing after rough working by using an end mill, so that the number of working steps is increased. In a case where each stationary vane 4 and the shroud 9 or the main shroud 10 to which the stationary vane 4 is fixed are formed by independent members, a problem of the need for the step of fixing the stationary vanes 4 and the increase in the number of components parts are encountered. In this embodiment, the stationary vanes 4 are formed integrally with a flat surface of one of the shroud 9 or the main shroud 10 perpendicular to the axis of rotation of the impeller 1 and, therefore, working with an end mill can be performed easily when a blank is cut to form the stationary vanes 4 and the shroud 9 or the main shroud 10 on which the stationary vanes 4 are formed.

Figure 3:
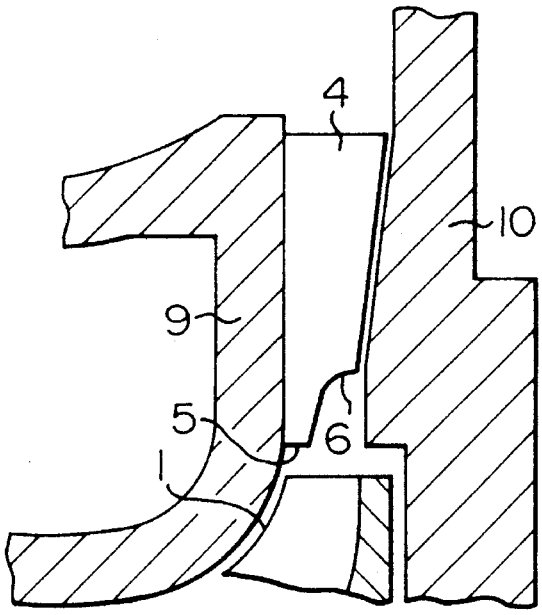
FIG. 3 is an axial sectional view of a second embodiment of the present invention.
Figure 4:
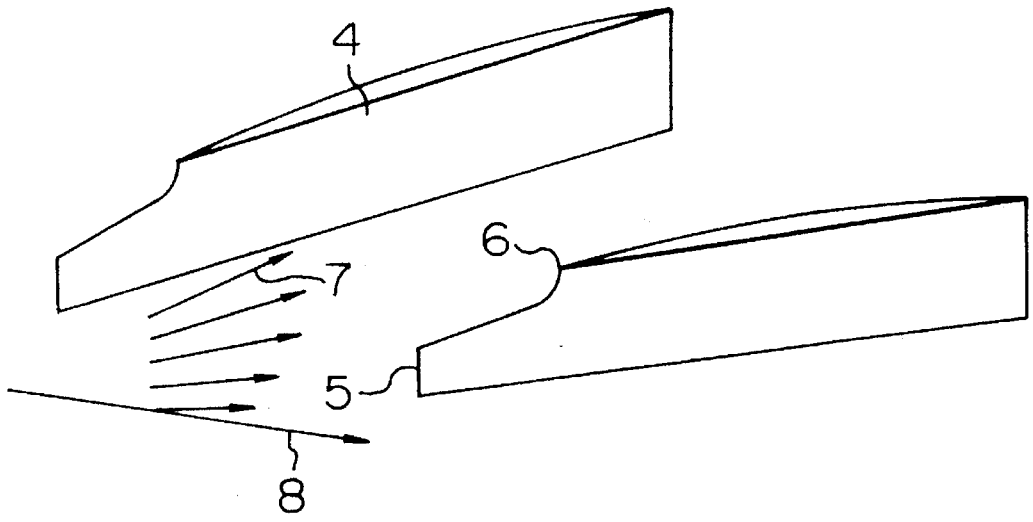
FIG. 4 is a perspective view of vanes showing the state of flow in the embodiment shown in FIG. 3.

FIGS. 3 and 4 illustrate the second embodiment of the present invention. FIG. 3 is an axial sectional view and FIG. 4 is a perspective view of stationary vanes 4.

This embodiment is characterized in that a front edge portion 5 of each stationary vane 4 adjacent the shroud 9 is extended closer to the impeller 1 relative to a front edge portion 6 of the vane 4 adjacent the main shroud 10.

The effect of this arrangement will be described with reference to FIG. 4. During a low-flow-rate operation, at the outlet of the impeller 1, the stagnation pressure of the flow in the vicinity of the shroud 9 is lower than that of the flow in the vicinity of the main shroud 10, and a reverse flow is liable to occur in a direction close to a tangential direction 8 of the impeller which is different from those of velocity vectors 7. For this reason, the front edge portion 5 of each stationary vane 4 adjacent the shroud 9 is brought closer to the impeller 1 to forcibly guide the flow from the impeller 1 so as to suppress the occurrence of a reverse flow between the outlet of the impeller and the front edges of the stationary vanes 4. As a result, stall cannot occur easily in the diffuser to assure that the operating range at the low-flow-rate side is widened.

Figure 5:
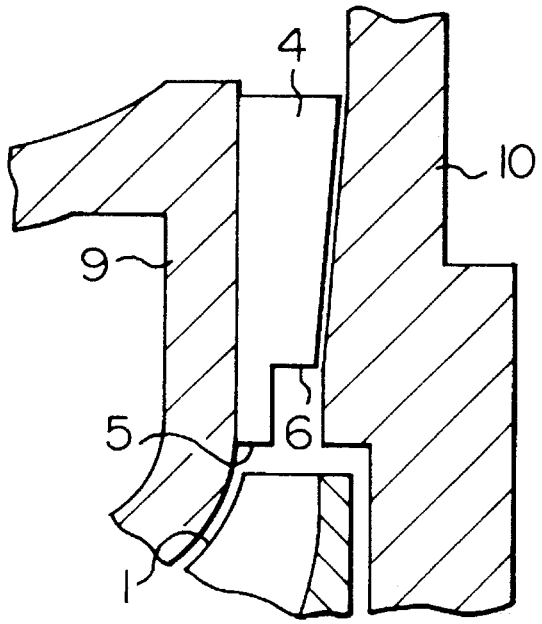
FIG. 5 is an axial sectional view of a third embodiment of the present invention.

FIG. 5 is an axial sectional view of the third embodiment of the present invention.

In the third embodiment, the front edge of each stationary vane 4 is stepped to form two front edge portions adjacent the shroud 9 and the main shroud 10 which are connected by a radially extending straight line, thereby simplifying the working for forming the front edge of the stationary vane.

Figure 6:
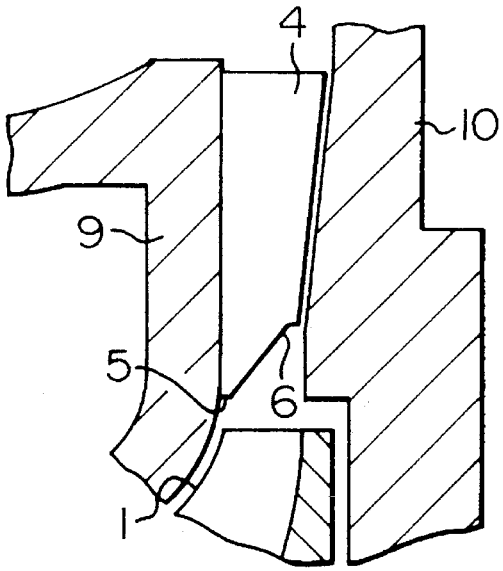
FIG. 6 is an axial sectional view of a fourth embodiment of the present invention.

FIG. 6 is an axial sectional view of the fourth embodiment of the present invention.

In the fourth embodiment, the front edge of each stationary vane 4 is stepped to form two front end portions adjacent the shroud 9 and the main shroud 10 which are connected by an oblique line, to thereby simplify the working for forming the front edge, as in the third embodiment.

Figure 7:
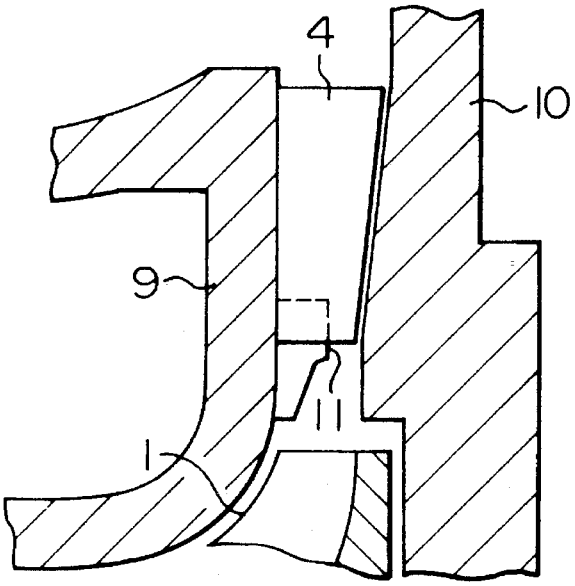
FIG. 7 is an axial sectional view of a fifth embodiment of the present invention taken on a plane containing the axis of rotation of the impeller.
Figure 8:
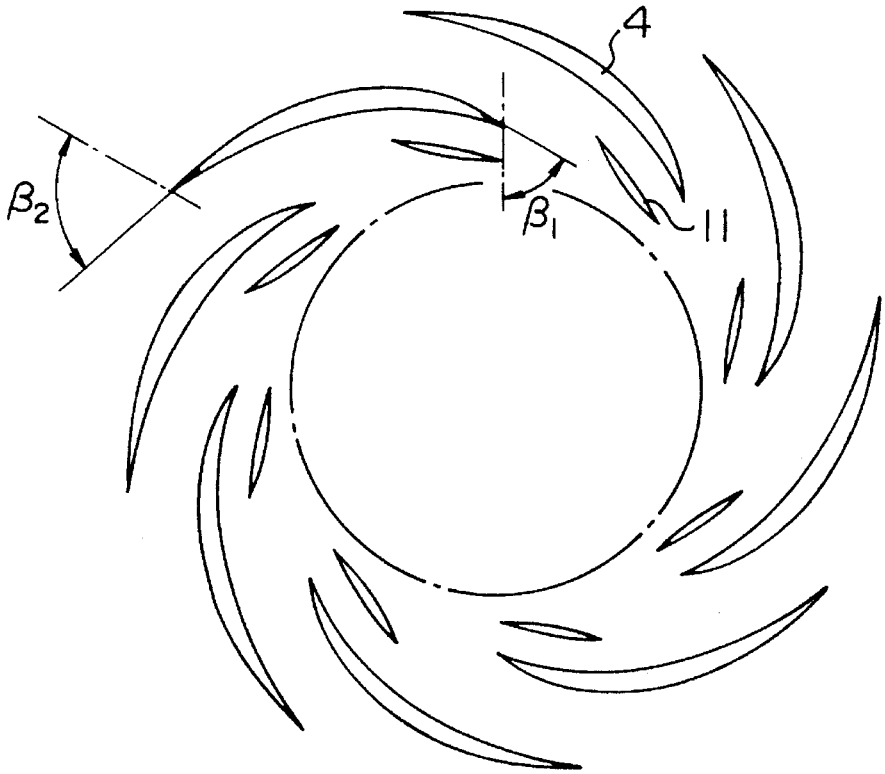
FIG. 8 is a plan view of the stationary vanes of the embodiment shown in FIG. 7 showing the arrangement of the vanes.
Figure 9:
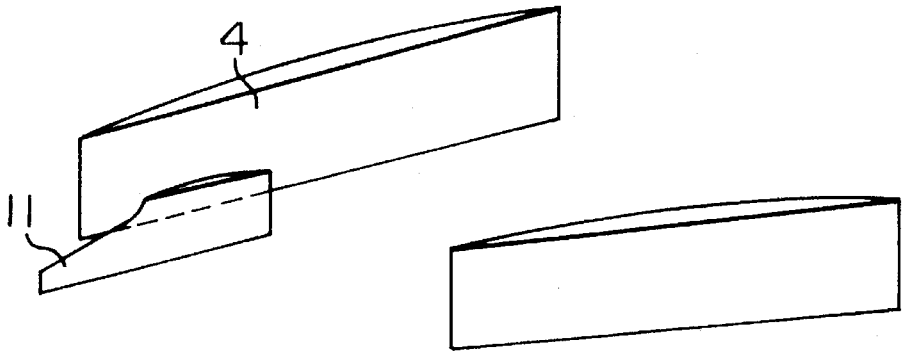
FIG. 9 is a perspective view of the stationary vanes of the embodiment shown in FIG. 7 showing the arrangement of the vanes.

FIGS. 7, 8 and 9 illustrate the fifth embodiment of the present invention. FIG. 7 is an axial sectional view of the centrifugal compressor taken in a plane containing the axis of the rotating shaft of the impeller, FIG. 8 is a plan view showing the arrangement of stationary vanes, and FIG. 9 is a perspective view showing the arrangement of the stationary vanes.

In this embodiment, an auxiliary vane 11 having a chord shorter than that of each of the stationary vanes 4 and also having a height equal to or smaller than that of each of the stationary vanes 4 is provided adjacent the inlet side of each stationary vane 4 and is formed integrally with the flat surface of the shroud 9 or the main shroud 10 perpendicular to the axis of the rotating shaft of the impeller 1 such that one of two surfaces of the auxiliary vane 11 is opposed to an adjacent stationary vane 4. The auxiliary vane 11 has front edge portions adjacent the shroud 9 and the main shroud 10 which are connected by a partially curved line. The front edge portion of the auxiliary vane 11 adjacent the shroud 9 is closer to the impeller 1 than the other front edge portion adjacent the main shroud 10.

The effect of the auxiliary vanes 11 will be described with reference to FIGS. 8 and 9.

The auxiliary vanes 11 also have an effect of forcibly guiding the flow from the impeller 1 to suppress the occurrence of a reverse flow between the outlet of the impeller 1 and the front edges of the stationary vanes 4, as in the case of the front edge portions 5 of the stationary vanes 4 adjacent the shroud 9 shown in FIG. 4. Since the auxiliary vanes 11 are independent of the stationary vanes 4, the same effect as one achieved by increasing the number of stationary vanes 4 is achieved at the inlet of the diffuser, and the guiding effect of this embodiment is higher than that of the second embodiment. If the number of stationary vanes 4 is simply increased without changing the basic construction, the performance of the diffuser is reduced due to a reduction in the sectional area of the flow passages between the vanes and an increase in the wetted area. In this embodiment, auxiliary vanes 11 are disposed so that only one of the two surfaces of each auxiliary vane 11 faces the adjacent stationary vane 4 to avoid a reduction in the sectional area of the flow passages between the vanes. Since each auxiliary vane 11 is smaller than the stationary vane 4 in chordal length and equal to or smaller than the stationary vane 4 in height, the increase in the wetted area is small. Therefore, this embodiment does not suffer from considerable reduction in the diffuser performance in comparison with the case where the number of the stationary vanes 4 is simply increased without changing the basic construction. This embodiment ensures a greater increase in the operating range on the low-flow-rate side than the second embodiment.

Figure 10:
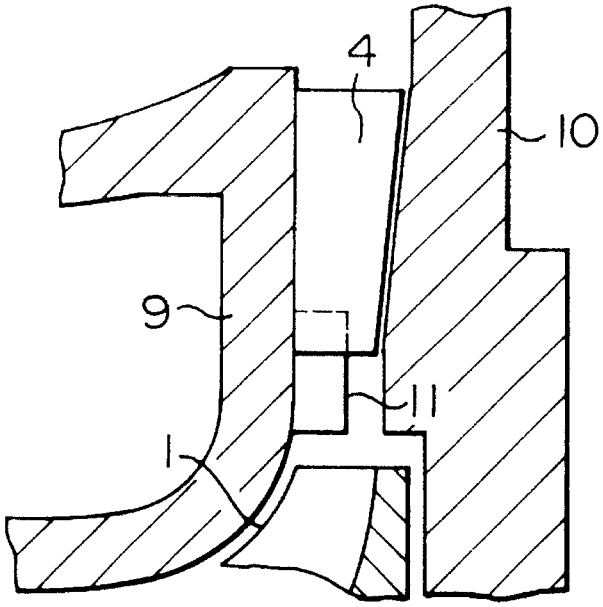
FIG. 10 is an axial sectional view of a sixth embodiment of the present invention.

FIG. 10 is an axial sectional view of the sixth embodiment of the present invention.

In the sixth embodiment, the front edge of each of auxiliary vanes 11 is formed by a straight line parallel to the axis of the rotating shaft 13, so that the working for forming the front edge is performed is simplified.

Figure 11:
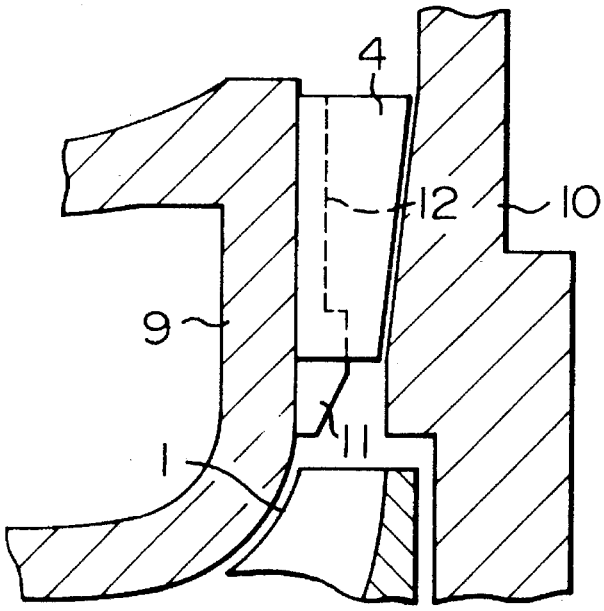
FIG. 11 is an axial sectional view of a seventh embodiment of the present invention.
Figure 12:
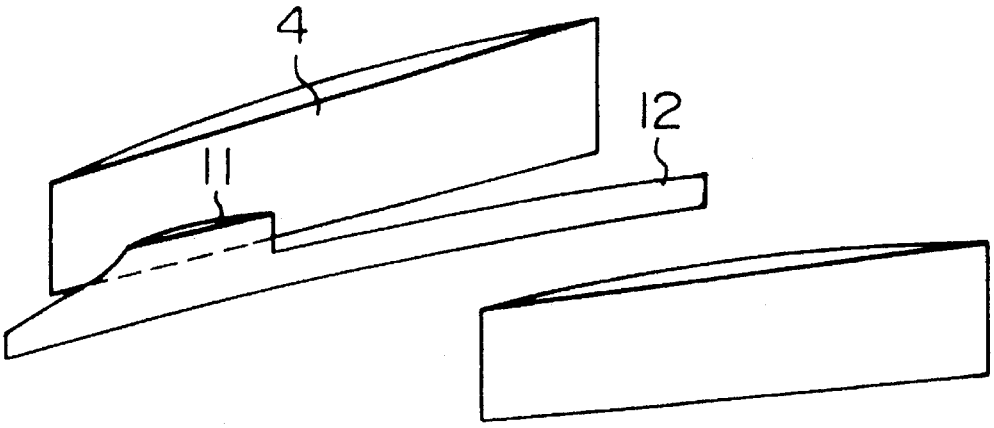
FIG. 12 is a perspective view of the stationary vanes of the embodiment shown in FIG. 11.

FIGS. 11 and 12 illustrate the seventh embodiment of the present invention. FIG. 11 is an axial sectional view and FIG. 12 is a perspective view of stationary vanes 4.

In the seventh embodiment, a partition plate 12 having a width smaller than that of an associated auxiliary vane 11 and extending along a stationary vane 4 is formed on and connected to the downstream end of the auxiliary vane 11, whereby eddies flowing from root portions of the auxiliary vanes 11 are suppressed to thereby reduce the amount of flow energy consumed by such eddies. As a result, the efficiency of the compressor can be further improved.

Figure 13:
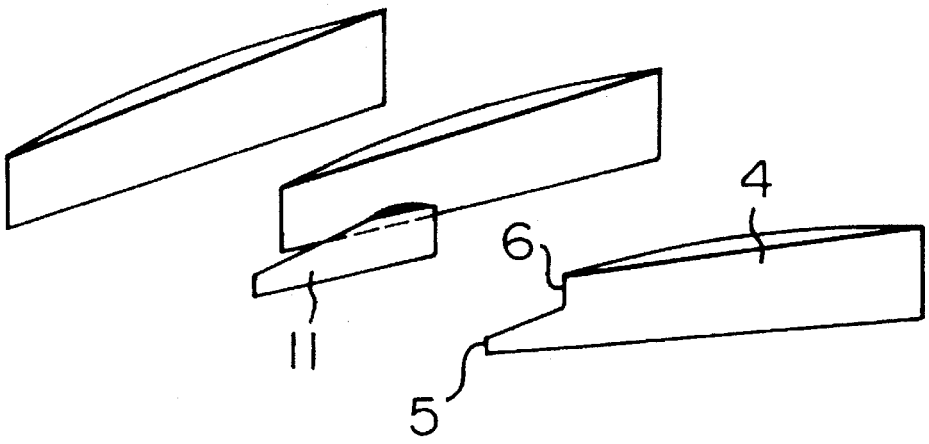
FIG. 13 is a perspective view of an eighth embodiment of the present invention.

FIG. 13 is a perspective view illustrating the eighth embodiment of the present invention.

In the eighth embodiment, stationary vanes 4 each having a part of the front edge extended closer to the impeller 1 and other stationary vanes each not having such front edge are mixedly provided. In addition, stationary vanes 4 associated with auxiliary vanes 11 and other stationary vanes 4 not associated with auxiliary vanes 11 are mixedly provided.

To effectively arrange these different stationary vanes 4, the following arrangement may be adopted.

That is, if a scroll collector is provided downstream of the diffuser, 50% or less of all the stationary vanes 4 positioned on the downstream side of a tongue portion in the circumferential direction have no front edge portions extended closer to the impeller 1 and are disposed without auxiliary vanes 11 associated therewith, and other stationary vanes 4 each have a portion of front edge extended closer to the impeller and are disposed with auxiliary vanes 11 associated therewith. The stationary vanes 4 that have no front edge portions extended closer to the impeller 1 and that are disposed without auxiliary vanes 11 associated therewith tend to cause stall in comparison with the other stationary vanes 4 each of which has a portion of front edge extended closer to the impeller 1 and is associated with an auxiliary vane 11. Accordingly, a stall region is fixed to the stationary vanes 4 having no front edge portions extended closer to the impeller 1 and disposed without auxiliary vanes 11 associated therewith, so that the rotating stall is suppressed. If no tongue portion is provided downstream of the diffuser as in the case of a return channel, 50% or less of stationary vanes which have no front edge portions extended closer to the impeller 1 and are disposed without auxiliary vanes 11 associated therewith are successively disposed to obtain the same effect.

According to this embodiment, it is possible to suppress the rotating stall of the diffuser that would occur easily during a low-flow-rate operation.

According to the present invention, it is possible to obtain a centrifugal compressor which can be worked easily, which provides a wide operating range from a low flow rate to a high flow rate and which is compact in size.

What is claimed is:

1. A centrifugal compressor comprising:

an impeller;

a diffuser operative to convert kinetic energy of fluid discharged from said impeller into pressure and having a shroud and a main shroud, said shroud being perpendicular to an axis of rotation of said impeller; and stationary vanes disposed in said diffuser, wherein the distance between said shroud and said main shroud is smaller at an inlet side of said diffuser than at an outlet side of said diffuser, said stationary vanes are integral with said shroud so that an end surface of each of said stationary vanes at an end of the vane in the direction of the height of the vane forms a free end, the height of each stationary vane is lower at the inlet side than at the outlet side, and the height of each of said stationary vanes occupies substantially all of said distance between said shroud and said main shroud for a major portion of a length of said stationary blades;

wherein an angle of each stationary vane adjacent the outlet side to the radial direction of said impeller is larger than an angle of the stationary vane adjacent the inlet side to the radial direction of said impeller.

2. A centrifugal compressor according to claim 1, wherein a front edge portion of each stationary vane adjacent said shroud is closer to said impeller than the other front edge portion of the stationary vane adjacent said main shroud.

3. A centrifugal compressor comprising:

an impeller;

a diffuser operative to convert kinetic energy of fluid discharged from said impeller into pressure and having a shroud and a main shroud, said shroud being perpendicular to an axis of rotation of said impeller; and stationary vanes disposed in said diffuser, wherein the distance between said shroud and said main shroud is smaller at an inlet side of said diffuser than at an outlet side of said diffuser, said stationary vanes are integral with said shroud so that an end surface of each of said stationary vanes at an end of the vane in the direction of the height of the vane forms a free end, the height of each stationary vane is lower at the inlet side than at the outlet side, and the height of each of said stationary vanes occupies substantially all of said distance between said shroud and said main shroud for a major portion of a length of said stationary blades;

wherein an angle of each stationary vane adjacent the outlet side to the radial direction of said impeller is larger than an angle of the stationary vane adjacent the inlet side to the radial direction of said impeller, and wherein auxiliary vanes are formed integrally with said shroud, each of said auxiliary vanes having a chord shorter than that of each of said stationary vanes and a height not greater than that of each of said stationary vanes, and said auxiliary vanes are disposed adjacent the inlet ends of said stationary vanes such that one of two surfaces of each auxiliary vane is opposed to an associated stationary vane.

4. A centrifugal compressor comprising:

an impeller;

a diffuser operative to convert kinetic energy of fluid discharged from said impeller into pressure and having a shroud and a main shroud, said shroud being perpendicular to an axis of rotation of said impeller; and stationary vanes disposed in said diffuser, wherein the distance between said shroud and said main shroud is smaller at an inlet side of said diffuser than at an outlet side of said diffuser, said stationary vanes are integral with said shroud so that an end surface of each of said stationary vanes at an end of the vane in the direction of the height of the vane forms a free end, the height of each stationary vane is lower at the inlet side than at the outlet side, and the height of each of said stationary vanes occupies substantially all of said distance between said shroud and said main shroud for a major portion of a length of said stationary blades;

wherein an angle of each stationary vane adjacent the outlet side to the radial direction of said impeller is larger than an angle of the stationary vane adjacent the inlet side to the radial direction of said impeller, wherein auxiliary vanes are formed integrally with said shroud, each of said auxiliary vanes having a chord shorter than that of each of said stationary vanes and a height not greater than that of each of said stationary vanes, and said auxiliary vanes are disposed adjacent the inlet ends of said stationary vanes such that one of two surfaces of each auxiliary vane is opposed to an associated stationary vane, and wherein each of said auxiliary vanes has a front edge inclined from said shroud toward said main shroud.

5. A centrifugal compressor comprising:

an impeller;

a diffuser operative to convert kinetic energy of fluid discharged from said impeller into pressure and having a shroud and a main shroud, said shroud being perpendicular to an axis of rotation of said impeller; and stationary vanes disposed in said diffuser, wherein the distance between said shroud and said main shroud is smaller at an inlet side of said diffuser than at an outlet side of said diffuser, said stationary vanes are integral with said shroud so that an end surface of each of said stationary vanes at an end of the vane in the direction of the height of the vane forms a free end, the height of each stationary vane is lower at the inlet side than at the outlet side, and the height of each of said stationary vanes occupies substantially all of said distance between said shroud and said main shroud for a major portion of a length of said stationary blades, wherein an angle of each stationary vane adjacent the outlet side to the radial direction of said impeller is larger than an angle of the stationary vane adjacent the inlet side to the radial direction of said impeller, wherein auxiliary vanes are formed integrally with said shroud, each of said auxiliary vanes having a chord shorter than that of each of said stationary vanes and a height not greater than that of each of said stationary vanes, and said auxiliary vanes are disposed adjacent the inlet ends of said stationary vanes such that one of two surfaces of each auxiliary vane is opposed to an associated stationary vane, and wherein a partition plate is connected to a downstream end of each of said auxiliary vanes and extends along an associated stationary vane, said partition plate having a height lower than that of the auxiliary vane.

6. A centrifugal compressor comprising:

an impeller;

a diffuser operative to convert kinetic energy of fluid discharged from said impeller into pressure and having a shroud and a main shroud, said shroud being perpendicular to the axis of rotation of said impeller; and stationary vanes disposed in said diffuser, wherein the distance between said shroud and said main shroud is smaller at an inlet side of said diffuser than at an outlet side of said diffuser, said stationary vanes are integral with said shroud so that an end surface of each of said stationary vanes at an end of the vane in the direction of the height of the vane forms a free end, the height of each stationary vane is lower at the inlet side that at the outlet side, and the height of each stationary vanes occupies substantially all of said distance between said shroud and said main shroud for a major portion of a length of said stationary blades, wherein an angle of each stationary vane adjacent the outlet side to the radial direction of said impeller is larger than an angle of the stationary vane adjacent the inlet side to the radial direction of said impeller, wherein auxiliary vanes are formed integrally with said shroud, each of said auxiliary vanes having a chord shorter than that of each of said stationary vanes and a height not greater than that of each of said stationary vanes, and said auxiliary vanes are disposed adjacent the inlet ends of said stationary vanes such that one of two surfaces of each auxiliary vane is opposed to an associated stationary vane, wherein each of said auxiliary vanes has a front edge inclined from said shroud toward said main shroud, and wherein a partition plate is connected to a downstream end of each of said auxiliary vanes and extends along an associated stationary vane, said partition plate having a height lower than that of the auxiliary vane.

7. A centrifugal compressor comprising:

an impeller;

a diffuser operative to convert kinetic energy of fluid discharged from said impeller into pressure and having a shroud and a main shroud, said shroud being perpendicular to the axis of rotation of said impeller; and stationary vanes disposed in said diffuser, wherein the distance between said shroud and said main shroud is smaller at an inlet side of said diffuser than at an outlet side of said diffuser, said stationary vanes are integral with said shroud so that an end surface of each of said stationary vanes at an end of the vane in the direction of the height of the vane forms a free end, the height of each stationary vane is lower at the inlet side than at the outlet side, and the height of each of said stationary vanes occupies substantially all of said distance between said shroud and said main shroud for a major portion of a length of said stationary blades, wherein an angle of each stationary vane adjacent the outlet side to the radial direction of said impeller is larger than an angle of the stationary vane adjacent the inlet side to the radial direction of said impeller, wherein a front edge portion of each stationary vane adjacent said shroud is closer to said impeller that the other front edge portion of the stationary vane adjacent said main shroud, and wherein auxiliary vanes are formed integrally with said shroud, each of said auxiliary vanes having a chord shorter than that of each of said stationary vanes and a height not greater than that of each of said stationary vanes, and said auxiliary vanes are disposed adjacent the inlet ends of said stationary vanes such that one of two surfaces of each auxiliary vane is opposed to an associated stationary vane.

* * * * *